United States Patent [19]

Lekebusch et al.

[11] Patent Number: 4,722,711

[45] Date of Patent: Feb. 2, 1988

[54] METHOD AND APPARATUS FOR POSITION ORIENTATION OF A METAL HALIDE LAMP BASE ASSEMBLY

[75] Inventors: Ronald C. Lekebusch, Goffstown; John T. O'Neil, Jr., Manchester; Martin E. Muzeroll, Merrimack, all of N.H.

[73] Assignee: GTE Products Corporation, Danvers, Mass.

[21] Appl. No.: 920,815

[22] Filed: Nov. 24, 1986

Related U.S. Application Data

[62] Division of Ser. No. 810,953, Dec. 19, 1985.

[51] Int. Cl.[4] ..... H01J 9/42

[52] U.S. Cl. ..... 445/64; 219/160; 439/615

[58] Field of Search ..... 445/3, 4, 64; 228/103, 228/104; 339/278 L, 146; 219/161, 158, 160; 439/615

[56] References Cited

U.S. PATENT DOCUMENTS 1,687,504 10/1928 Moffit et al. ..... 445/64
1,995,148 3/1935 Illingworth ..... 445/64 X
2,716,178 8/1955 Wallace ..... 219/158

FOREIGN PATENT DOCUMENTS 544363 4/1942 United Kingdom ..... 219/161

*Primary Examiner*—Kenneth J. Ramsey
*Attorney, Agent, or Firm*—Joseph S. Romanow; José W. Jimenez

[57] ABSTRACT

A method and an apparatus for position orienting a base assembly of a metal halide lamp is describe for maintaining the curved arc tube in the upward position when the lamp is inserted in a socket. Once the lamp has been fully assembled and sealed a locator structure is attached to the base shell in order to create a base assembly which will properly position the lamp when it is in the socket. The welding apparatus of the present invention resistance welds the locator structure onto the base shell once the locator structure has been aligned approximaely 90 degrees counterclockwise from the tip of the curved portion of the arc tube when viewed from the dome end of the lamp. The lamp resulting from the method and use of the apparatus will be more inexpensive and will not have the problems of a loose base or a cracked seal.

3 Claims, 11 Drawing Figures

METHOD AND APPARATUS FOR POSITION ORIENTATION OF A METAL HALIDE LAMP BASE ASSEMBLY

This is a divisional application of co-pending application Ser. No. 810,953 filed on Dec. 19, 1985.

TECHNICAL FIELD

The present invention relates in general to metal halide lamps and in particular to a method and apparatus for position orienting a metal halide lamp base with respect to a curved arc tube.

BACKGROUND

Metal halide lamps that are made with curved or arched arc tubes must be operated horizontally with the curve of the arc tube in the upward or arch uppermost position (see U.S. Pat. No. 3,858,078). To accomplish this, the base and socket must provide a means of interlocking such that when the lamp is screwed into the socket firmly, the arc tube curve will be upward. Presently, the socket used has a notch and the base has a pin added to it so that when the lamp is screwed into the socket, it will stop in a predetermined position. This is in contrast to the usual screw type base that is used with prior art commercial metal halide lamps; a screw type base is not a positioning base and can be used in prior art lamps since the arc tubes thereof are straight cylinders.

Referring now to FIGS. 1 and 2, which will aid in clearly illustrating any problems associated with the prior art lamp bases. FIG. 1 illustrates a typical lamp base 10 comprised of a base shell 12, a base eyelet 14 and a base pin 16. FIG. 1 also illustrates a headed brass pin 16 which is affixed into and protrudes from base shell 12 in order to position the curved arc tube of a metal halide lamp. FIG. 2 illustrates a cross section of a typical socket 20 made of a porcelain casing 22 that has been partially cut away such that notch 24 can be seen. To make the pin and notch arrangement workable, a given dimension of X, X being about one inch with a positive tolerance of 1/32 of an inch was established between base eyelet 14 and pin 16, in FIG. 1. Notch 24 (illustrated in FIG. 2) in the socket shell 26 is located such that when base pin 16 is within the dimensions stated, eyelet 14 on base shell 12 will make contact with tab 28 in the socket. The tolerance of plus 1/32 of an inch translates into rotational tolerance of about 45 degrees of rotation or about $\frac{5}{8}$ of an inch distance along the crest of the thread on which the pin is located.

The present method of pinning and attaching the base to the lamp is as follows: a hole is drilled in base shell 12 on the crest of the thread to meet the dimension stated with respect to FIG. 1. A headed brass pin 16 is then inserted into the hole with the head on the inside of base shell 12 and securely soldered in place. Since the soldering discolors the brass, the use of a nickel base is necessary for good cosmetics. During the lamp sealing process, four dimples are molded into the seal to permit a threaded inner shell having tabs with corresponding dimples to be snapped in place. Once in place, base shell 12 is securely screwed onto the inner shell and then is staked or pierced in three places to lock it to the inner shell.

When sealing lamps with a curved arc tube, the tip on the arc tube is located with respect to one of the dimples in the mold. In the basing process, the inner shell is selectively snapped into place such that the thread location on the inner shell corresponds to the dimple orientation accomplished during the sealing process. When the base is screwed onto the inner shell, the pin should be approximately 90 degrees counterclockwise from the tip on the curved portion of the arc tube when viewed from the dome end of the metal halide lamp. FIG. 3 illustrates a metal halide discharge lamp 30 when viewed from the top dome end looking down onto the lamp. Lamp 30 has an outer envelope 32, a curved arc tube 34, arc tube pressed end 36, an arc tube tip 38, a base shell 40 and a locating pin 42 similar to FIG. 1. FIG. 3 also illustrates a plane of the arc tube and support structure which runs along the line B–B′. A 90 degree angle is marked between the plane of the arc tube B–B′ and the plane created by the arc tube and the locating pin marked C–C′.

The position orientation or locating arrangement in the past has not been very accurate, since the base has normally been manually screwed onto the inner shell until snug then the pin location is checked with respect to plane B–B′ to see if the angle between them is 90 degrees±5 degrees. If the angle is not within this range, the base must be loosened or tightened to meet the requirement. This action allows for a certain amount of movement to meet the angular requirement, however if the base is backed off too much from the snug position, the base will be loose after staking. If the base is over torqued, the lamp seal will crack. In either case, the lamp is rejected. The problems associated with the present pin locating methods are as follows: possible rejections may occur due to the loose base or cracked seal and over torquing can cause severe field and life problems. The present method does not lend itself well to an efficient assembly line operation and predrilling of bases and soldering pins on are time consuming and expensive. Since soldering discolors a brass base, nickel plated bases must be used for good cosmetics, therefore nickel plating is an added expense.

Since production operations are constantly changing, such as utilizing a threaded glass seal in place of dimples and an inner shell for attaching the base, the present method as described is not adaptable for use with a threaded mold lamp seal. Therefore, a need exists for a method of position orienting a metal halide lamp base assembly with respect to the curved arc tube.

SUMMARY OF THE INVENTION

It is, therefore, a primary object of this invention to provide a method and an apparatus for position orienting a base with respect to a curved arc tube which will eliminate the aforementioned problems.

In accordance with one aspect of this invention, there is provided a method for position orienting a base assembly with respect to a curved arc tube of a high intensity discharge lamp, the base assembly including a base shell having an eyelet and a locator structure attached thereto. The method comprises the steps of providing within the discharge lamp an arc tube support structure coplanar with the arc tube and providing means for welding the locator structure to the base shell, the welding means capable of separately receiving and supporting the lamp and the locator structure. The method further includes disposing the locator within the welding means and positioning the lamp within the welding means such that the base shell and the locator are in operative contact before welding. Next a light source is provided proximate to the welding means and the light beam of the light source is aligned perpendicular to both the longitudinal axis of the lamp and to the plane formed by the arc tube and the locator structure. Furthermore, a screen is provided opposite the lamp such that a shadow image of the arc tube support structure is formed thereon when the light beam passes through the center of the neck of the lamp and impinges on the screen. Finally, the lamp is rotated radially within the welding means until the plane formed by the arc tube and the support structure is perpendicular to the arc tube - locator plane: Thereupon the welding means is activated to weld the locator structure to the base shell, thereby forming a base assembly that is position oriented with the curved arc tube.

In accordance with another aspect of this invention there is provided a position oriented high intensity discharge lamp comprising a light transmissive outer envelope and a curved arc tube disposed within the envelope and supported by an arc tube support structure that is coplanar with the arc tube. The lamp further includes a base assembly attached to the outer envelope, the base assembly having a base eyelet and a locator structure affixed externally thereto, the locator disposed at a predetermined distance from the base eyelet.

In accordance with yet another aspect of this invention, there is provided an apparatus for attaching a tab-type structure to the base of a high intensity discharge lamp. The apparatus comprises a resistance welder and a welding fixture attached to the welder including a frame, a bottom electrode disposed within the frame having an aperture surface, and means for guiding the lamp within the apparatus in contact with the frame. The apparatus further includes a back stop structure having a surface positioned proximate to the guide means for minimizing the lamp movement within the apparatus and a retractable top electrode positioned above and spaced from the bottom electrode.

BEST MODE FOR CARRYING OUT THE INVENTION

For a better understanding of the present invention together with other and further objects, advantages and capabilities thereof reference is made to the following disclosure and appended claims in connection with the above described drawings.

Figure 1:
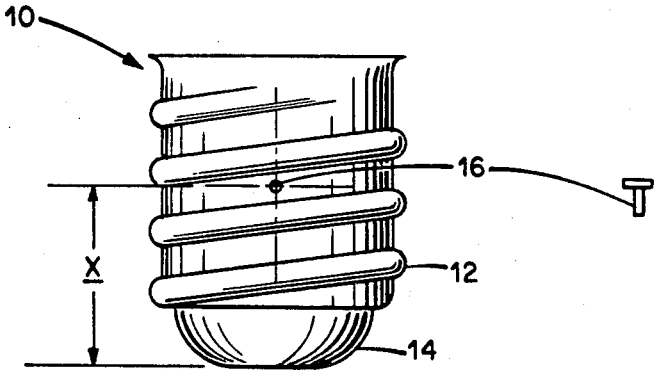
PRIOR ART Fig. 1.
FIG. 1 illustrates an example of a typical curved arc tube metal halide lamp base.
Figure 2:
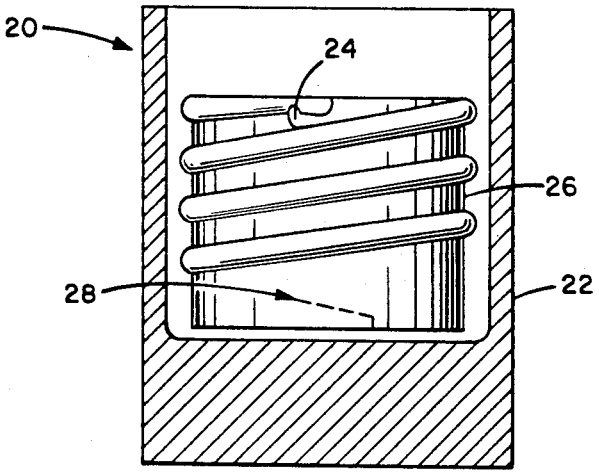
PRIOR ART Fig. 2.
FIG. 2 illustrates a cross section of a known socket for a high intensity discharge lamp.
Figure 3:
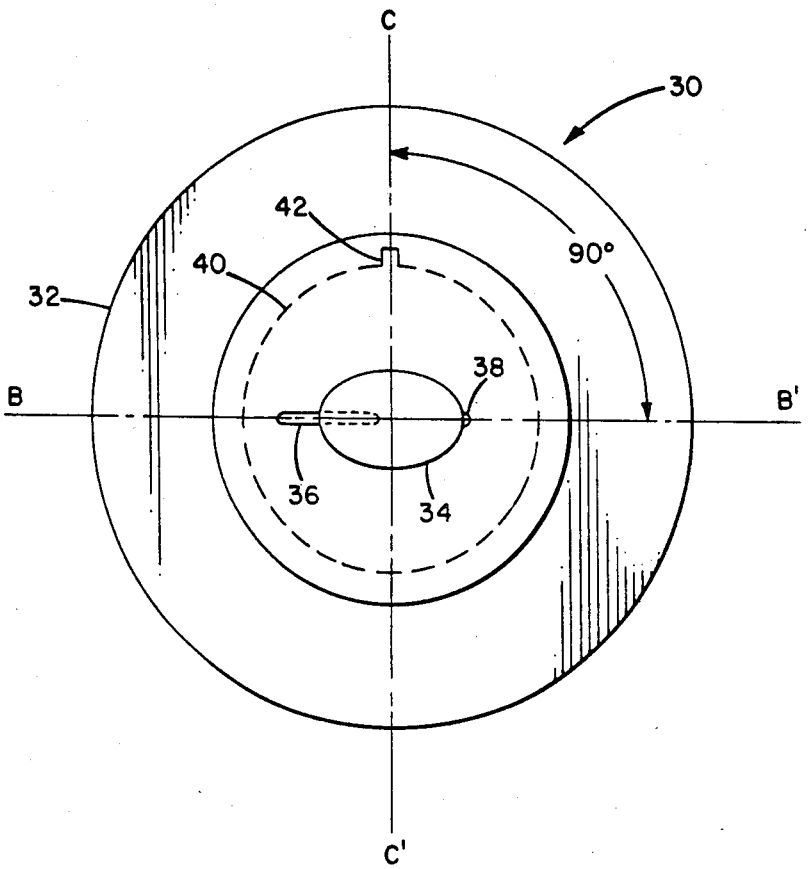
FIG. 3 illustrates the top or dome end view when looking down onto a curved arc tube metal halide lamp.
Figure 4A:
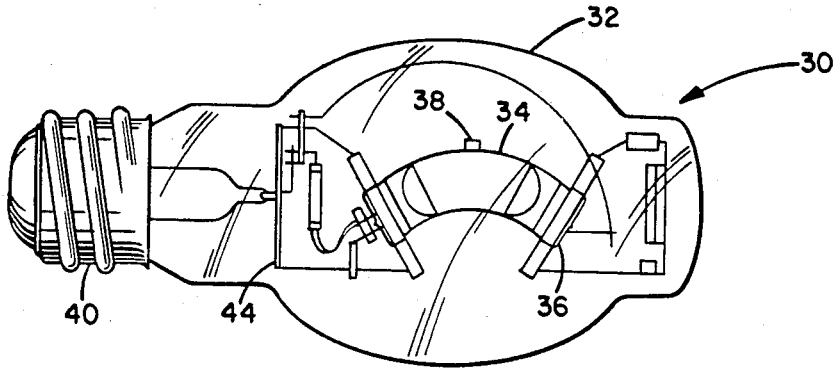
FIGS. 4A through 4C illustrate an actual metal halide lamp containing a curved arc tube therein, a high intensity discharge lamp having the improved locator structure attached to the base and enlarged view of the improved locator structure, respectively.
Figure 4B:
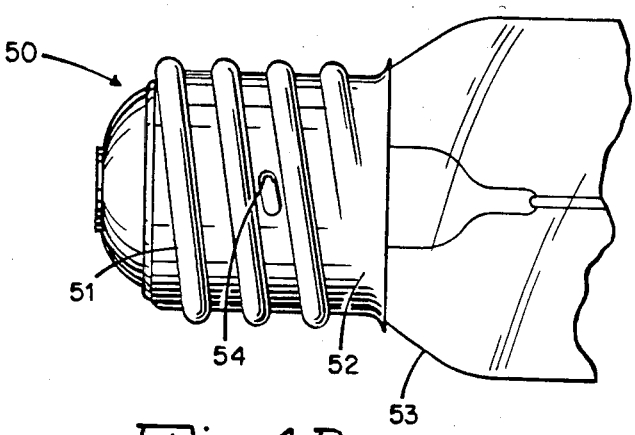
Figure 4C:
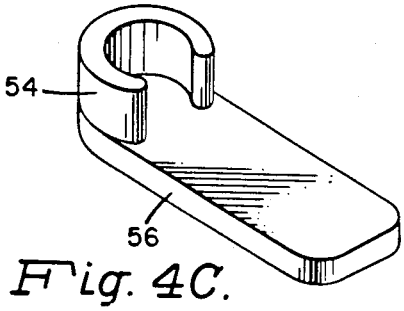

FIGS. 1, 2 and 3 were used to help describe some of the problems associated with the prior art methods of positioning or position orienting a base with respect to a curved arc tube. Reference will be made throughout the specification to FIGS. 1 and 3 in order to describe the improved method and apparatus for position orienting a base with respect to a curved arc tube. With respect to FIGS. 4A–4C, FIG. 4A illustrates a known metal halide lamp 30 in a horizontal position having a curved arc tube. Lamp 30 in FIG. 4A includes an outer envelope 32, an arc tube 34, an arc tube pressed end 36, an arc tube tip 38, a base shell 40 and an arc tube support structure 44. FIG. 4B partially illustrates an improved metal halide lamp 50 and lamp neck 53 having a base assembly 51 which includes a base shell 52 and a locator structure 54. FIG. 4C illustrates an enlarged view locator structure 54 and surface 56 which will be attached to base shell 52 upon forming the base assembly 51 illustrated in FIG. 4B.

Figure 5B:
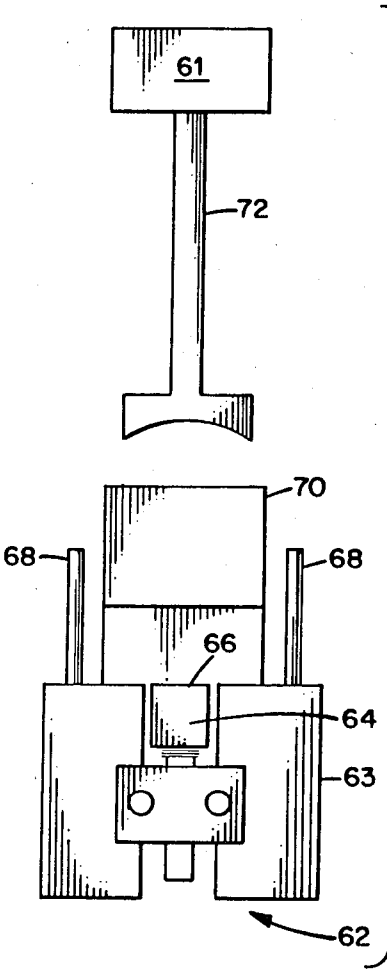
FIGS. 5A and 5B illustrate side and front views of the welding apparatus for attaching the locator structure onto the lamp base.
Figure 5A:
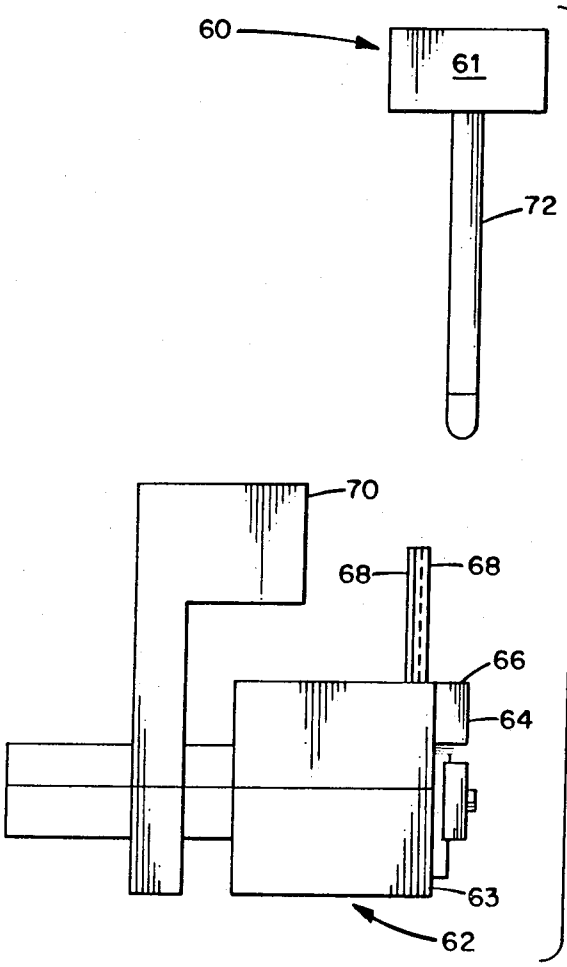

According to one embodiment of the present invention, a method for position orienting a base assembly with respect to a curved arc tube of a high intensity discharge lamp will be described. The lamp of FIG. 4A is aligned as viewed in FIG. 3 so that the plane of the arc tube B–B′ as shown in FIG. 3 is aligned with the start with the first thread on the threaded mold of the glass, this alignment being accomplished during lamp sealing. The lamps sealing, exhaust and basing are then completed, including the base soldering operation. A newly designed tab-type locator 54 shown in FIG. 4C is then placed in a welding apparatus 60 which is illustrated in FIGS. 5A and 5B. Welding apparatus 60 illustrated in FIGS. 5A and 5B provides a means for welding locator structure 54 to base shell 52. The welding apparatus is capable of separately receiving and supporting lamp 50 and locator structure 54. As illustrated in FIG. 4C locator structure 54 is L-shaped in form.

FIGS. 5A and 5B illustrate apparatus 60 for attaching a tab-type structure to the base of a high intensity discharge lamp. Apparatus 60 comprises a resistance welder 61 and welding fixture 62, attached to welder 61, that includes a frame 63, a bottom electrode 64 disposed within frame 63, having an apertured surface 66, and two guide pins 68 to guide a lamp within fixture 62 positioned on either side of bottom electrode 64. A back stop 70 is positioned proximate to guide pins 68 and a retractable top electrode 72 is positioned above and spaced from bottom electrode 64. Aperture 66 of bottom electrode 64 supports locator structure 54 that is to be attached to the lamp base.

The locator structure 54 is next placed in aperture 66 of bottom electrode 64 of apparatus 60. Lamp 50 is then placed between guide pins 68 with the base eyelet being placed in operative contact with back stop structure 70. Fixture 62 is designed such that the crest of the thread of base shell 52 is always positioned over bottom electrode 64 and aperture 66. With the base eyelet close to back stop 70 the plane of the arc tube B–B′, as aligned in FIG. 3, is near to the correct location. The tolerance of plus 1/32 of an inch (0.04 inches) translates into a rotational tolerance of about 45 degrees of rotation or about $\frac{5}{8}$ of an inch along the crest of the thread on which tab locator structure 54 is to be located. With the alignment illustrated in FIG. 3, the proper tab location will always fall within that $\frac{5}{8}$ of an inch on the threaded crest. The tab or locator structure is now disposed within welding apparatus 60 and lamp 50 is positioned within welding apparatus 60 such that base shell 52 and locator 54 are in operative contact before welding (see FIG. 6).

Figure 6:
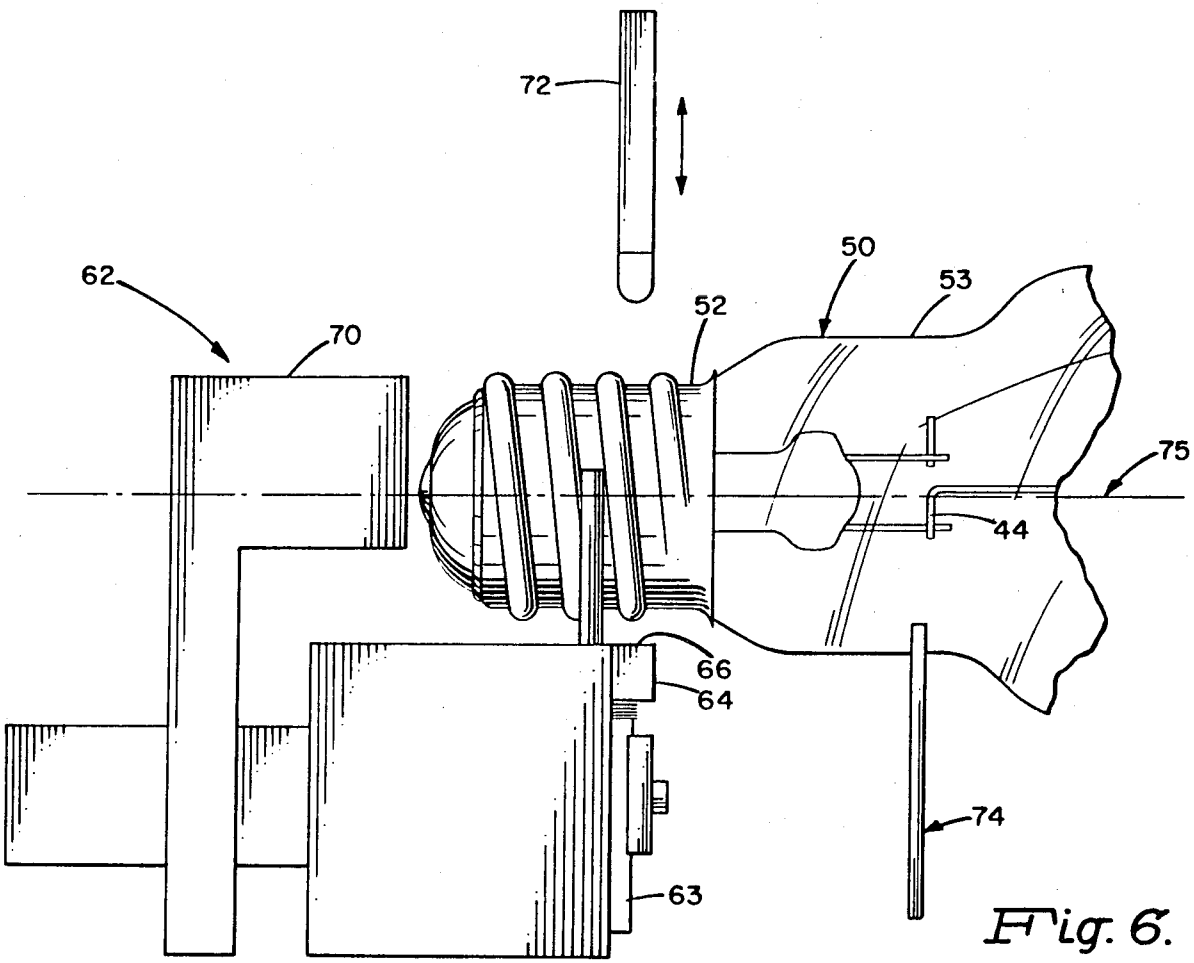
FIG. 6 illustrates how the high intensity discharge lamp is positioned in the welding fixture of FIG. 5.

Referring to FIG. 6, FIG. 6 illustrates lamp 50 positioned within welding fixture 62 and illustrates lamp support bracket 74, which supports lamp 50, that is space from electrode 64. FIG. 6 also illustrates that lamp 50 has a longitudinal axis 75 which will help in aligning locator structure 54 with the arc tube of lamp 50. FIG. 6 also illustrates that top electrode 72 is retractable and will come down on base shell 52 to weld locator 54 located within bottom electrode 64, to base shell 52 when the lamp has been properly aligned.

Figure 7A:
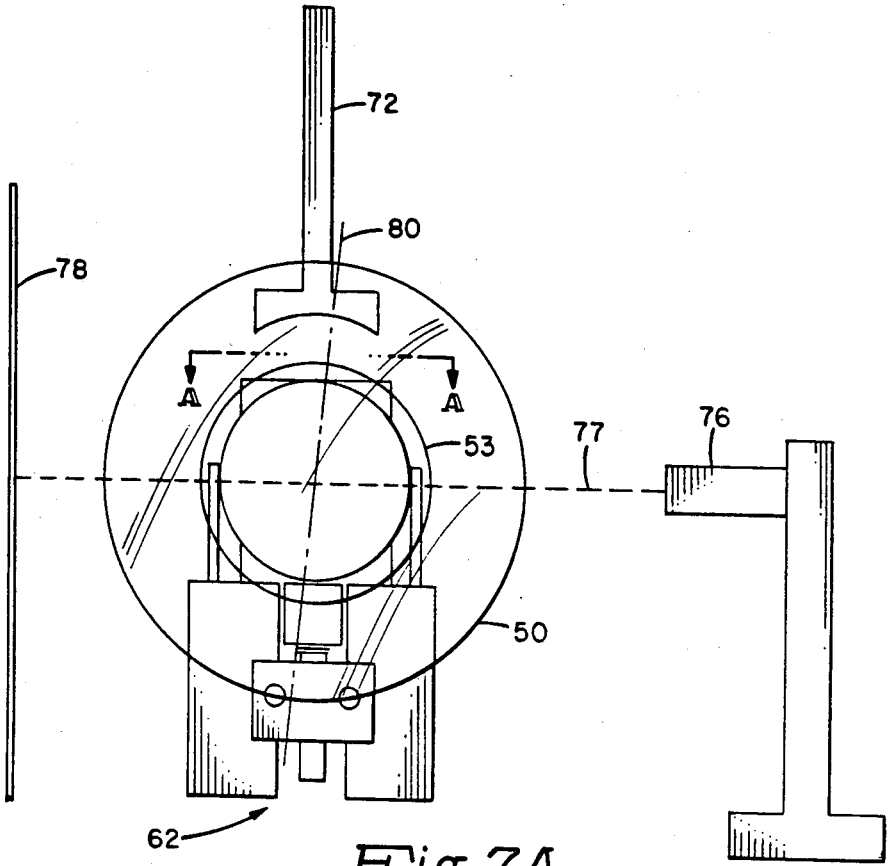
FIGS. 7A and 7B illustrate the lamp and the fixture position with respect to a light source and screen used for aligning the lamp base with the arc tube.
Figure 7B:
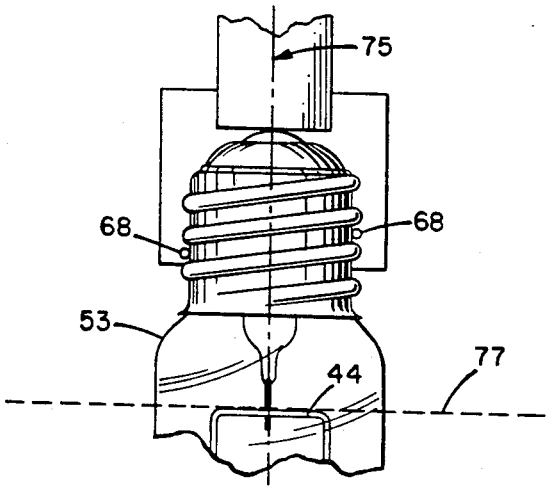

Referring now to FIGS. 7A and 7B, FIG. 7A illustrates lamp 50 positioned within fixture 62 with respect to a light source 76 and a target or screen 78 that is used for properly aligning the lamp base and the locator structure while FIG. 7B illustrates the view through section A–A' of FIG. 7A. In particular, light source 76 is located proximate to fixture 62 and a light beam 77 emitted from source 76 is aligned to be perpendicular to both longitudinal axis 75 (see FIG. 7B) of lamp 50 and to the plane formed by the arc tube and the locator structure which is identified as 80 in FIG. 7A. Light source 76 in FIG. 7A is positioned opposite lamp 50 such that light beam 77 passes through the center of the neck 53 of the lamp and impinges on screen 78. Light beam 77 is also adjusted to be perpendicular to the plane formed by the lower arc tube support structure 44, as illustrated in FIG. 7B, that is attached to arc tube 34 (see FIG. 7B).

In this particular embodiment, light beam 77 shinning through neck 53 of lamp 50 will show 2 shadow lines from lower support structure 44 onto screen 78 from the two legs of lower support 44. Lamp 50 is then rotated radially either clockwise or counterclockwise until the two legs of support 44 register as one shadow line on screen 78. At this point, the plane formed by the arc tube and the support structure is perpendicular to the arc tube locator plane 80. Tab or locator structure 54 in bottom electrode 64 is now about 90 degrees counterclockwise from arc tube tip 38 as shown in FIG. 3. Resistance welder 61 is now activated to resistance weld the tab or locator structure 54 to base shell 52, thereby forming a base assembly that is position oriented with respect to curved arc tube 34. FIG. 4B shows locator structure 54 welded to the base of the lamp.

Therefore, through the use of the aforedescribed method, an improved position oriented high intensity discharge lamp has resulted therefrom. Such an improved position oriented discharge lamp is partially illustrated from the lamp in FIG. 4A and the base assembly of FIG. 4B. The improved lamp comprises most of the elements of the lamp illustrated in FIG. 4A with base assembly 51 of FIG. 4B. The locator structure 54 of base assembly 51 is disposed at a predetermined distance from the base eyelet. Locator structure 54 also has a predetermined rotational tolerance radially along base shell 52. The predetermined distance is within a range of about one inch to about 1.05 inches and the rotational tolerance is about 45 degrees of rotation along the crest of the thread of base shell 52.

The advantages of using such an improved metal halide lamp includes the absence of rejections due to loose bases or cracked seals. The base does not have any apertures (due to prior art predrilling to include the pins from the previous lamp) and welding of the locator structure onto the base will not discolor the brass base, therefore nickel plating of the base is an unnecessary manufacturing step which also increases the expense of the lamp.

While there have been shown and described what are at present considered the preferred embodiments of the invention, it will be obvious to those skilled in the art that various changes and modifications may be made therein without departing from the scope of the invention as defined by the appended claims.

What is claimed is:

1. An apparatus for attaching a tab-type structure to the base of a high intensity discharge lamp, said apparatus comprising:

a resistance welder; and a welding fixture attached to said welder including a frame, a bottom electrode disposed within said frame, having an apertured surface means for guiding said lamp within said apparatus in contact with said frame, a back stop structure having a surface positioned proximate to said guide means for minimizing lamp movement within said apparatus and a retractable top electrode positioned above and spaced from said bottom electrode;

wherein said apertured surface of said bottom electrode supports said tab-type structure to be attached to said lamp base.

2. An apparatus for attaching a tab-type structure to the base of a high intensity discharge lamp, said apparatus comprising:

a resistance welder; and a welding fixture attached to said welder including a frame, a bottom electrode disposed within said frame, having an apertured surface means for guiding said lamp within said apparatus in contact with said frame, a back stop structure having a surface positioned proximate to said guide means for minimizing lamp movement within said apparatus and a retractable top electrode positioned above and spaced from said bottom electrode;

wherein said guide means includes two guide pins to guide said lamp within said fixture, said guide pin positioned on said frame on either side of said bottom electrode.

3. An apparatus for attaching a tab-type structure to the base of a high intensity discharge lamp, said apparatus comprising:

a resistance welder;

a welding fixture attached to said welder including a frame, a bottom electrode disposed within said frame, having an apertured surface means for guiding said lamp within said apparatus in contact with said frame, a back stop structure having a surface positioned proximate to said guide means for minimizing lamp movement within said apparatus and a retractable top electrode positioned above and spaced from said bottom electrode;

a lamp support bracket spaced from said bottom electrode for supporting a lamp positioned within said apparatus; and a light source and screen, said light source disposed adjacent said welding fixture and emitting a light beam that passes through said lamp positioned within said fixture and creating a shadow image on said screen.

* * * * *